US011299245B2

(12) United States Patent
Harris

(10) Patent No.: US 11,299,245 B2
(45) Date of Patent: Apr. 12, 2022

(54) APPARATUS FOR INFLATING FLOATATION DEVICES

(71) Applicant: Bruce Raymond Harris, Terry, MS (US)

(72) Inventor: Bruce Raymond Harris, Terry, MS (US)

( * ) Notice: Subject to any disclaimer, the term of this patent is extended or adjusted under 35 U.S.C. 154(b) by 0 days.

(21) Appl. No.: 16/779,147

(22) Filed: Jan. 31, 2020

(65) Prior Publication Data

US 2020/0247512 A1 Aug. 6, 2020

Related U.S. Application Data

(60) Provisional application No. 62/799,378, filed on Jan. 31, 2019.

(51) Int. Cl.

| | |
|---|---|
| ***A45D 20/12*** | (2006.01) |
| ***B63C 9/00*** | (2006.01) |
| *A63H 27/10* | (2006.01) |

(52) U.S. Cl.

CPC ..... *B63C 9/00* (2013.01); *A45D 20/12* (2013.01); *A63H 2027/1033* (2013.01); *B63C 2009/0023* (2013.01)

(58) Field of Classification Search

CPC ..... A45D 20/10; A45D 20/20; A45D 20/12; B63C 2009/0023; B63C 9/00; A63H 2027/1033

See application file for complete search history.

(56) References Cited

U.S. PATENT DOCUMENTS

| | | | | |
|---|---|---|---|---|
| 3,860,174 | A | 1/1975 | Cercone | |
| 4,442,556 | A | 4/1984 | Craigie | |
| 4,629,182 | A | 12/1986 | Rader et al. | |
| 4,815,219 | A | 3/1989 | Binger | |
| 5,012,539 | A | 5/1991 | Grigg | |
| 5,075,910 | A | 12/1991 | Morten | |
| 6,000,079 | A * | 12/1999 | Dranger | A47C 4/54 425/522 |
| 6,568,611 | B1 | 5/2003 | Essenmacher | |
| 9,149,104 | B2 | 10/2015 | Yoe et al. | |
| 9,282,799 | B2 | 3/2016 | Courtney et al. | |
| 9,808,067 | B2 | 11/2017 | Sutter et al. | |
| 10,010,150 | B2 | 7/2018 | Courtney et al. | |
| 10,041,205 | B2 | 8/2018 | McLoughlin | |
| 2005/0084400 | A1 | 4/2005 | Tsai | |
| 2014/0096315 | A1 | 4/2014 | Dutchover | |

(Continued)

OTHER PUBLICATIONS

Ryobi, Retrieved from https://www.homedepot.com/p/RYOBI-ONE-18-Volt-Cordless-High-Volume-Power-Inflator-Tool-Only-P738/300997599?MERCH=REC-_-pipsem-_-308746324-_-300997599-_-N#overlay, Reviews indicate available 2018 (Year: 2018).*

(Continued)

*Primary Examiner* — Andrew Polay

(74) *Attorney, Agent, or Firm* — Dunlap Bennett & Ludwig, PLLC; Brendan E. Squire

(57) ABSTRACT

An apparatus and method for inflating an inflatable object, such as a floatation device. The inflation apparatus includes a component with a primary opening, the primary opening sized and shaped to accept air from an air source, such as a hair dryer. A secondary opening on an inflation adapter is sized and shaped to be in communication with a valve opening on the inflatable object.

10 Claims, 2 Drawing Sheets

(56) References Cited

U.S. PATENT DOCUMENTS

| | | | | |
|---|---|---|---|---|
| 2016/0250438 | A1* | 9/2016 | Harwood | A61M 16/0875 128/201.13 |
| 2018/0174499 | A1 | 6/2018 | De Grasse et al. | |
| 2019/0049027 | A1* | 2/2019 | Bais | A63H 33/00 |

OTHER PUBLICATIONS

Backpacking Light Instaflator from https://backpackinglight.com/forums/topic/46513/, Retrieved May 8, 2021, Comments from Apr. 2011 (Year: 2011).*

* cited by examiner

APPARATUS FOR INFLATING FLOATATION DEVICES

CROSS-REFERENCE TO RELATED APPLICATION

This application claims the benefit of priority of U.S. provisional application No. 62/799,378, filed Jan. 31, 2019, the contents of which are herein incorporated by reference.

BACKGROUND OF THE INVENTION

The present invention relates to floatation devices, or more particularly to apparatus for inflating floatation devices.

Inflating floatation devices by mouth is time consuming and physically exhausting. For larger inflatables, the user may also experience lightheadedness from the alteration of the user's normal respiration cycles.

As can be seen, there is a need for a convenient device for inflating floatation devices, that eliminates the need to use one's mouth and reduces manual intervention.

SUMMARY OF THE INVENTION

In one aspect of the present invention, an inflation device for coupling an air source with an inflatable object is disclosed. The inflation device includes a blower coupling formed as a hollow cylindrical body having a first end and a second end. An inlet opening is defined at the first end and is dimensioned to receive an outlet of the air source. A constriction at the second end narrows to a coupling. An inflation adapter is formed as a hollow tubular segment having a first end, configured to be received in the coupling, and a second end that is dimensioned to be received in an inflation valve of the inflatable object.

In some embodiments, the blower coupling is formed of a resilient material. Preferably, the resilient material is silicone.

In some embodiments, the inflation adapter is formed of a rigid material. In other embodiments, the inflation adapter is formed of a thermo plastic material.

In some embodiments, the constriction is frusto-conical.

In yet other embodiments, the air source is a hair dryer.

In other aspects of the invention, a method of inflating an inflatable object to a desired fill level is disclosed. The method includes attaching an inflation device to an outlet of an air source. The inflation device has a resilient hollow tubular segment having an opening to receive the outlet of the air source. A constriction is formed at an opposite end and terminates in an inflation coupling. A proximal end of an inflation adapter is attached to the inflation coupling.

In some embodiments, the method also includes attaching a distal end of the inflation adapter to a valve of the inflatable object. In other embodiments, the air source is operated to communicate a volume of air through the inflation device to obtain the desired fill level of the inflatable object.

In other embodiments, the inflation adapter is disconnected from the valve when the desired fill level has been reached.

In yet other embodiments, the air source is removed from the opening in the resilient hollow tubular segment. A volume of air is released from within the inflatable device through the inflation adapter to obtain the desired fill level.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an improved apparatus for inflating a floatation device. The inflation apparatus is configured to receive an end of a hair dryer, or other forced air source.

Figure 1:
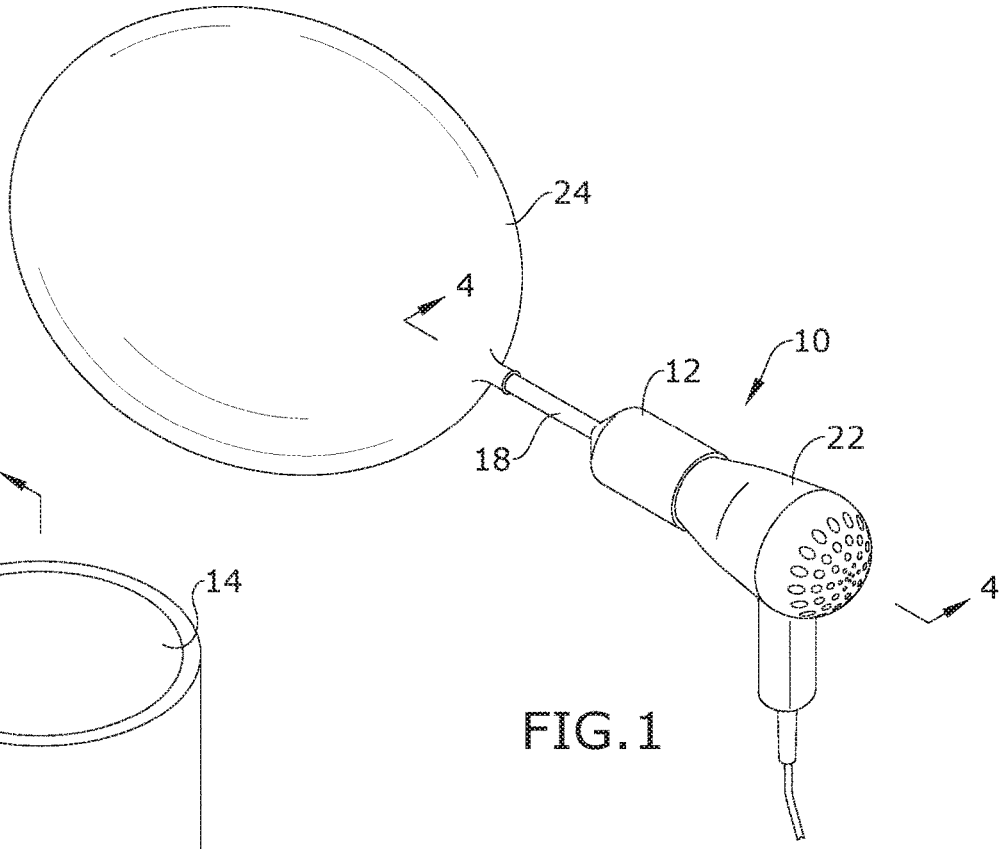
FIG. 1 is a perspective view of an inflation device, shown in an exemplary use.
Figure 2:
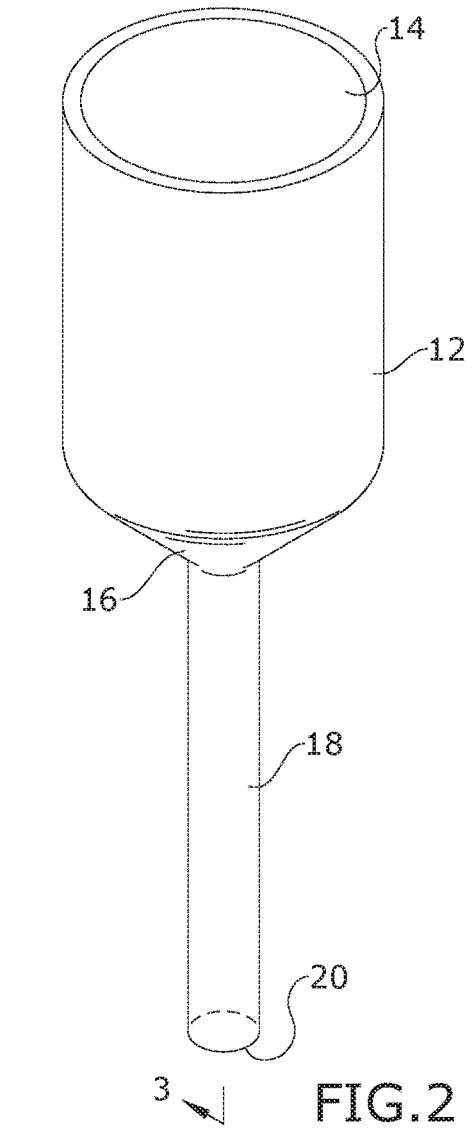
FIG. 2 is a perspective view of the inflation device.
Figure 3:
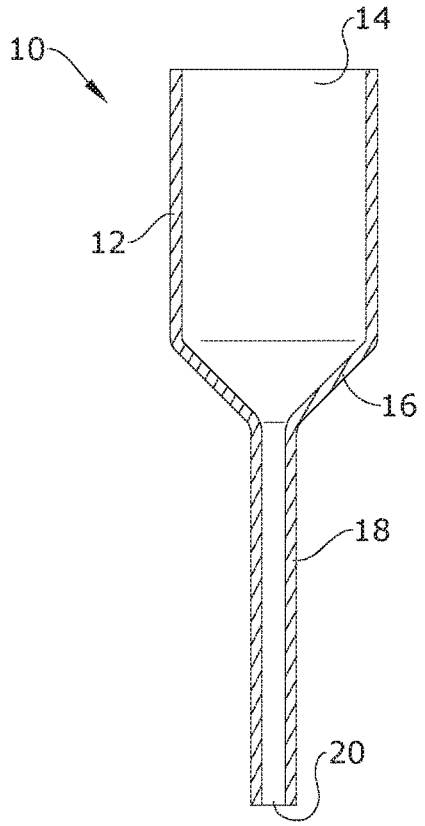
FIG. 3 is a section view of the inflation device, taken along line 3-3 in FIG. 2.
Figure 4:
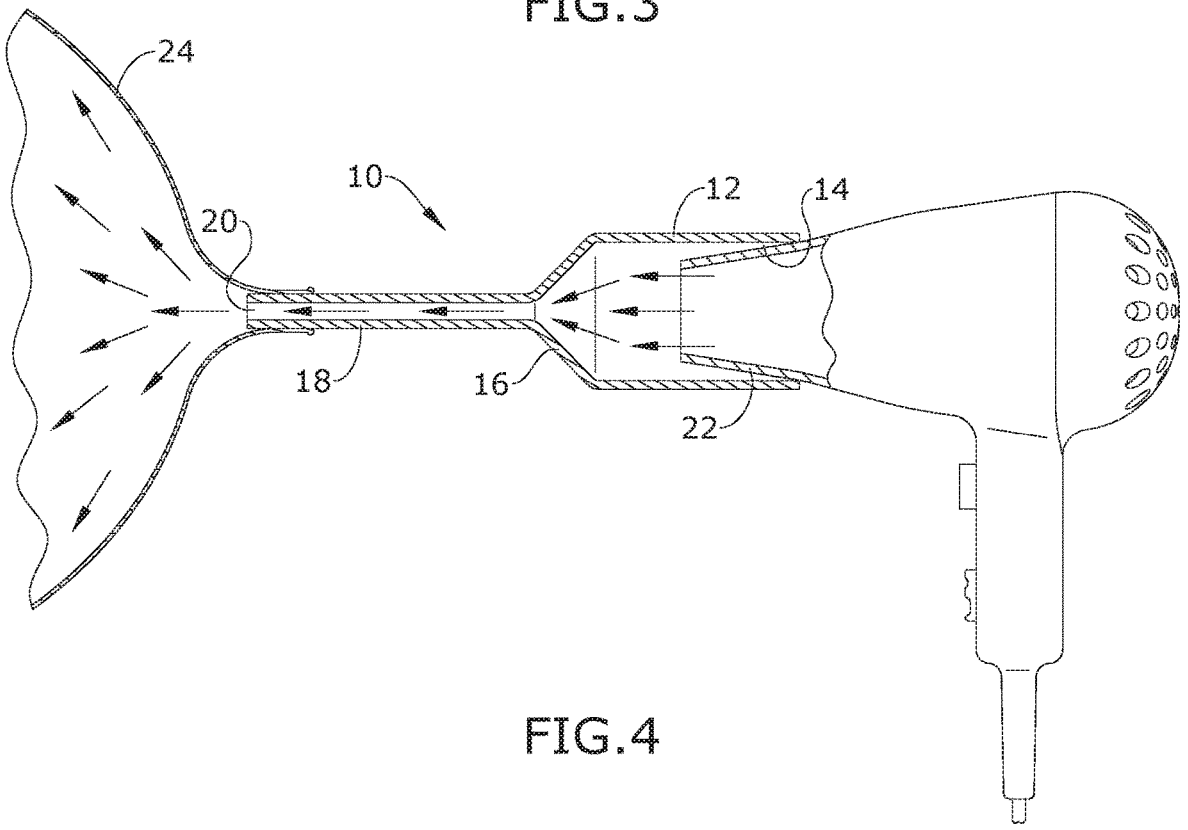
FIG. 4 is a section view of the inflation device, taken along line 4-4 in FIG. 1

As seen in reference to the drawings of FIGS. 1-4, the inflation apparatus 10 is formed in two segments, a blower coupling 12 and an inflation adapter 18. The blower coupling 12 is formed as a hollow cylindrical body having a first end and a second end. A primary opening 14 is provided at the first end of the blower coupling. The primary opening 14 is sized and shaped to accept an outlet end 22 of an air source, such as a hair dryer. The primary opening 14 may have an inner diameter of 2 inches and a length of approximately 3 inches to facilitate coupling with the outlet end of the hairdryer 22.

The inflation apparatus 10 has a constriction 16 at an intermediate position along the hollow cylindrical body. The constriction 16 is preferably frusto-conical in shape and narrows to couple with the inflation adapter 18 which is disposed at the second end of the hollow cylindrical body.

The inflation adapter 18 has an outlet opening 20 that communicates the air from the air source 22 to an inlet valve 26 of the inflatable object 24. The inflation adapter 18 is dimensioned to be received within the inlet valve 26. A first end of the inlet adapter 18 is dimensioned for coupling with the constriction 16 of the blower coupling 12. The inflation adapter 18 may have has an extended length of about 4 inches and an outer diameter of ½ inches to facilitate coupling of the inflation adapter 18 with an inlet valve 22 of the inflatable object 24 during inflation. The extended length allows for the user to grasp each of the inlet valve 22 and the inflation adapter 18 with their fingers during inflation.

In a preferred embodiment, the first segment of the inflation device 10 is formed of a resilient material, such as a silicone injection molding process, such that the primary opening 12 may be elastically fit to the outlet of the air source 22 and a first end of the inflation adapter 18 may couple with the constriction 16. The inflation adapter 18 is formed from a rigid or semi rigid thermoplastic material to facilitate the insertion of the inflation adapter 18 into the inlet valve 26 of the inflatable object 24.

In use, the user would connect the primary opening 12 to the outlet of the air source 22. The inflation adapter 18 is inserted into the inlet valve 26 and the air source 22 is operated to deliver a source of forced air to the primary opening 12. The airflow is constricted at the constriction 16 of the inflation apparatus and is delivered via the inflation adapter 18 to deliver the air source to fill the interior of the inflatable object 24.

When the inflatable object 24 has reached a desired fill level, the user may separate the inflation adapter 18 from the inlet valve 26 and seal the inflation valve 26. The air source 22 may be then be deactivated.

The inflation apparatus 10 may also be utilized to deflate the inflatable object 24. In many instances, the inflation valve 26 of the inflatable object may have a check valve feature to prevent the air contained within the inflatable object 24 from escaping. In the case of deflation, the inflation adapter 18 is inserted into the inflation valve 26 to retain the check valve in an open condition, so that air contained within the inflatable object 24 may be permitted to escape through the inflation apparatus 10.

It should be understood, of course, that the foregoing relates to exemplary embodiments of the invention and that modifications may be made without departing from the spirit and scope of the invention as set forth in the following claims.

What is claimed is:

1. An inflation device for coupling an air source with an inflatable object, comprising:

a blower coupling formed of a resilient silicone material as a hollow cylindrical body having a length of 3 inches between a first end and a second end;

an inlet opening having an inner diameter of 2 inches at the first end is dimensioned to resiliently and elastically couple with an outlet of the air source;

a constriction at the second end narrows to a coupling; and an inflation adapter formed as an elongate hollow tubular segment having a proximal end configured to be received in the coupling and a distal end dimensioned with an outer diameter of ½ inch to be received in an inflation valve of the inflatable object, the inflation adapter having a length of 4 inches to permit grasping of the inflation valve and the inflation adapter with a user's fingers for retention with the inflation valve during inflation of the inflatable object with the air source.

2. The inflation device of claim 1, wherein the inflation adapter is formed of a rigid material, such that the distal end of the inflation adapter is engageable with a check valve of the inflation valve to retain the check valve in an open position.

3. The inflation device of claim 1, wherein the inflation adapter is formed of a thermo plastic material.

4. The inflation device of claim 1, wherein the constriction is frusto-conical.

5. The inflation device of claim 1, wherein the air source is a hair dryer.

6. A method of inflating an inflatable object to a desired fill level, comprising:

attaching an inflation device to an outlet of an air source, the inflation device having a resilient hollow tubular segment having an opening with a 2-inch inner diameter and a length of 3 inches to resiliently receive the outlet of the air source to couple the inflation device to the air source, and a constriction at an opposite end terminating in an inflation coupling; and attaching a proximal end of an inflation adapter having a length of 4 inches and an outer diameter of ½ inch to the inflation coupling.

7. The method of claim 6, further comprising:

attaching a distal end of the inflation adapter to a valve of the inflatable object, wherein the length of the inflation adapter permits grasping of the valve and the inflation adapter with a user's fingers for retention with the inflation valve during inflation of the inflatable object with the air source.

8. The method of claim 7, further comprising:

operating the air source to communicate a volume of air through the inflation device to obtain the desired fill level of the inflatable object.

9. The method of claim 7, further comprising:

disconnecting the inflation adapter from the valve when the desired fill level has been reached.

10. The method of claim 6, further comprising:

removing the air source from the opening in the resilient hollow tubular segment; and releasing a volume of air from within the inflatable device through the inflation adapter to obtain the desired fill level.

* * * * *